US006694533B2

(12) United States Patent
Chiang

(10) Patent No.: US 6,694,533 B2
(45) Date of Patent: Feb. 24, 2004

(54) SWIMMING GOGGLES WITH IMPROVED ADJUSTABILITY

(76) Inventor: Herman Chiang, 11F-2 No. 634-9 Ching Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/194,092

(22) Filed: Jul. 11, 2002

(65) Prior Publication Data

US 2004/0006813 A1 Jan. 15, 2004

(51) Int. Cl.[7] ..... A61F 9/02
(52) U.S. Cl. ..... 2/428; 2/445
(58) Field of Search ..... 2/426, 428, 429, 2/430, 440, 442, 445, 446, 452; 351/43, 155, 156

(56) References Cited

U.S. PATENT DOCUMENTS 4,688,272 A * 8/1987 Leonardi ..... 2/431
5,706,526 A * 1/1998 Huang ..... 2/428
5,857,221 A * 1/1999 Geneve et al. ..... 2/428
6,349,417 B1 * 2/2002 Chiang ..... 2/428
6,505,352 B2 * 1/2003 Chiang ..... 2/428
6,546,565 B2 * 4/2003 Chiang ..... 2/428

* cited by examiner

*Primary Examiner*—Gary L. Welch
(74) *Attorney, Agent, or Firm*—Pro-Techtor International Services

(57) ABSTRACT

A pair of swimming goggles for swimming pool purposes includes left and right lens frames each of which has a lens unit, a nose bridge connecting inner sides of the left and right lens frames, and a head strap. The nose bridge includes a body portion for touching a wearer's nose, and a guide portion with a first bar and a second bar respectively extending from opposite sides of said body portion. Each of said first bar and said second bar has a parallel section for providing the lens frames to move thereon, and a connection portion connecting the head strap. Thus, the swimming goggles can effectively guard against interference each other during the adjusting and can respectively conform with a wearer's eyehole contour, so as to provide more comfortable fitting and prevent the seepage of water when the swimming goggles are in use.

14 Claims, 5 Drawing Sheets

SWIMMING GOGGLES WITH IMPROVED ADJUSTABILITY

BACKGROUND OF THE INVENTION

1. Field of the Invention

The present invention relates generally to swimming goggles, in particular to a pair of swimming goggles with a nose bridge which can be conform with wearer's nose by configuration, and which can effectively guard against interference each other during adjusting.

2. Prior Art

Swimming goggles have been known for many years. Each pair of swimming goggles has a nose bridge which The nose bridges may be classified as two common types by function. One is a fixing type of nose bridge which is generally formed integrally with lens frames, and the other is an adjustable type of nose bridge which is connected to lens frames and can be adjusted for difference spacing. The adjustable type of nose bridge is well known in the prior art, for example, U.S. Pat. Nos. 5,502,844, 5,857,221, 5,950, 248, 6,119,277, 6,119,279 etc. However, all the adjustable types of nose ridges have a main drawback that a wearer has to take off the swimming goggles from her/his head before adjusting, and both lens frames of the swimming goggles shall be adversely affected each other and be moved toward left or right during the wearer adjusting the lens frames to match her or his eyeholes. Thus, the lens frames may not correctly and securely match the wearer's eyeholes, even though she or he has done their best. So that the swimming goggles with the adjustable nose bridge is not only inconvenient but also uncomfortable in use.

Moreover, it is uncomfortable that the nose bridge contacts the wearer's nose with heavy press in use, because the wearer's nose is sloped but the nose bridge is planar so that the nose bridge contacts the wearer's nose with a small surface.

SUMMARY OF THE INVENTION

An object of the present invention is to provide a pair of swimming goggles with a adjustable nose bridge which can overcome the drawbacks of the aforementioned prior art, which has a sloped configuration to match a wearer's shape of nose, and which can be connected lens frames of the swimming goggles to provide each lens frame can be adjusted on the nose bridge, so that the lens frames do not affect each other during adjusting, and can be securely matched with the periphery of wearer's eyeholes respectively for getting more comfortable and preventing effectively the seepage of water when the swimming goggles is in use.

Another object of the present invention is to provide a pair of swimming goggles which keeps each lens frame parallel moving with a wearer's eyeball during adjusting, thereby causing the lens of each lens frame is also parallel with the wearer's eyeball, and which allows good peripheral vision without distorting the swimmer's view.

To achieve the above objects, swimming goggles in accordance with the present invention comprises left and right lens frames, a nose bridge connecting inner sides of the left and right lens frames, a head strap, and a fastener mechanism connecting the head strap. Each of the left and right lens frames has an inner periphery that defines a lens retaining space for receiving a lens unit. Upper and lower portions of the periphery of the left and right lens frames having at least a connection base with a receiving hole therein. The nose bridge includes a body portion for touching a wearer's nose, a guide portion, and a connection portion. The guide portion has a first bar and a second bar respectively extending from opposite sides of the body portion and passing through the receiving hole of each connection base. The connection portion extends from an end of the first bar and the second bar respectively. The fastener mechanism has an assembled section coupling with the connection portion, and a strap linking section connecting the head strap.

According to one feature of the present invention, a nose bridge is made of flexible and rigid material, which includes a body portion for touching a wearer's nose, a guide portion with a first bar and a second bar which respectively extend from opposite sides of said body portion, each of said first bar and said second bar having a parallel section, and a connection portion for connecting a strap head.

According to the above mentioned feature, the body portion has an outer surface and an inner surface for touching a wearer's nose, the inner surface has an upper edge and a lower edge located in different orientation, so as to conformed with the slope of the wearer's nose in use.

According to another feature of the present invention, a connection base is protruded on upper and lower portion of the periphery of each lens frame for holding when each lens frame is adjusted. Each connection base has a receiving hole for providing the first bar and the second bar passing through respectively. The shape and size of the receiving holes is the same as the lateral section of the first bar and the second bar in order to move each lens frame securely along the first bar and the second bar, thereby causing a lens unit of each lens frame to be parallel with a wearer's eyeball.

According to more features of the present invention, a fastener mechanism includes an assemble section coupled with said connection portion and a strap linking section connected to a head strap.

BRIEF DESCRIPTION OF THE DRAWINGS

Other features and advantages of the present invention will become apparent in the following detailed description of the preferred embodiments with reference to the accompanying drawings of which.

DETAILED DESCRIPTION OF THE PREFERRED EMBODIMENT

Figure 1:
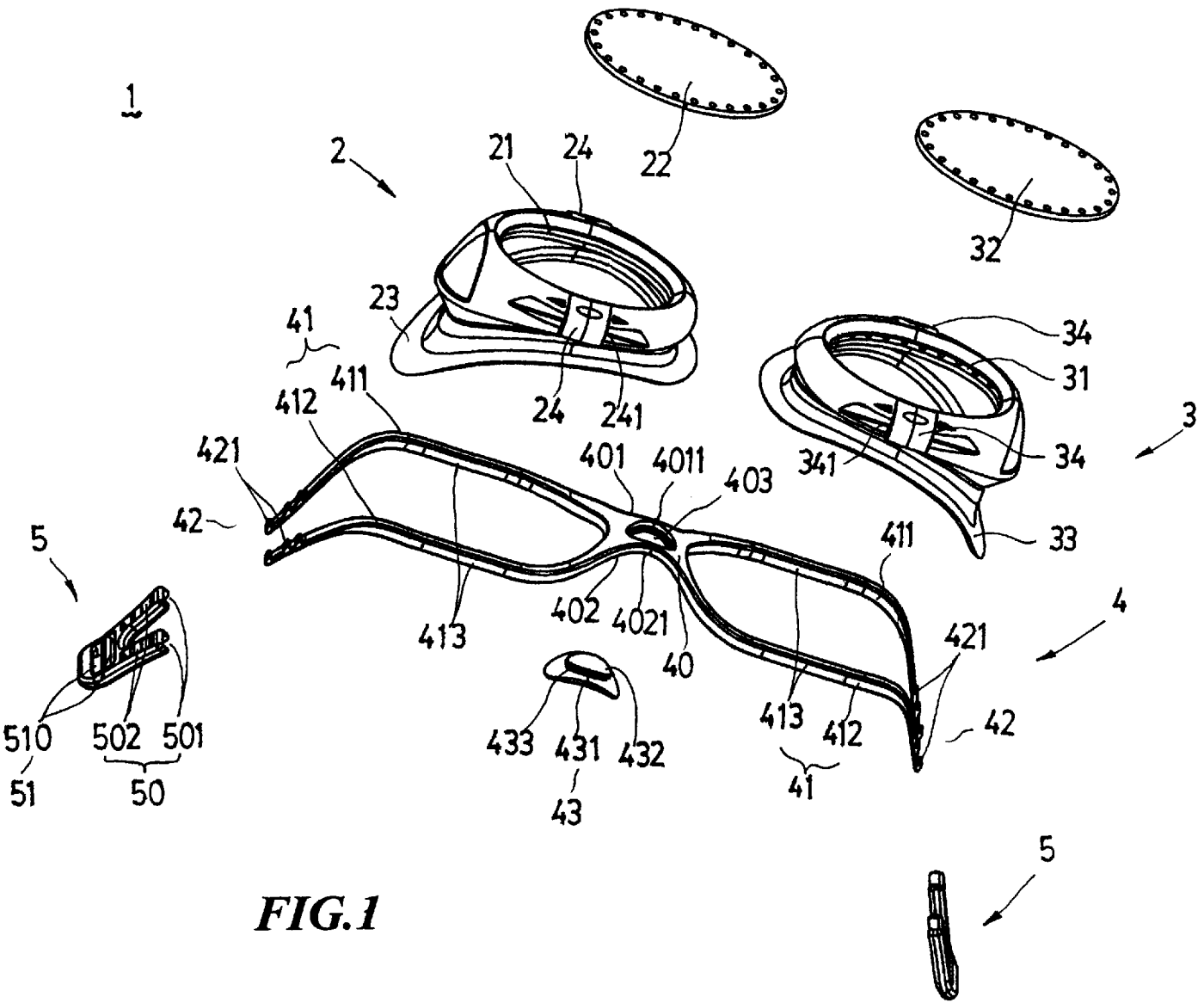
FIG. 1 is a perspective exploded view of a pair of swimming goggles of the present invention.

Referring to FIG. 1, a pair of swimming goggles 1 according to a preferred embodiment of the present invention includes a right lens frame 2, a left lens frame 3, a nose bridge 4, a fastener mechanism 5 and a head strap (not shown). Each of the lens frames 2,3 has a lens retaining space 21,31 for receiving a lens unit 22,32 therein. The right lens frame 2 and the left lens frame 3 respectively have gaskets 23,33 each of which is formed integrally with and far away from the side of each of the lens units 22,32 for touching the periphery of a wearer's eyehole. The upper and lower portions of the periphery of the lens frames 2,3 respectively have connection bases 24,34 which are protruded thereon for holding when each lens frame 2,3 is adjusted. Receiving holes 241,341 are respectively disposed in the connection bases 24,34.

Figure 4:
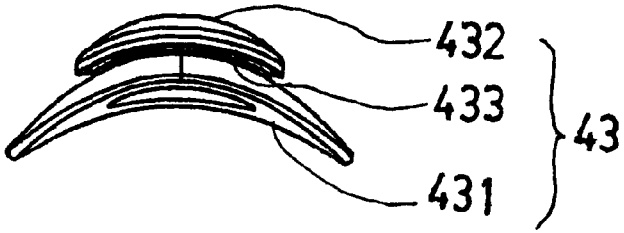
FIG. 4 is a perspective view of a nose pad of the present invention.
Figure 5:
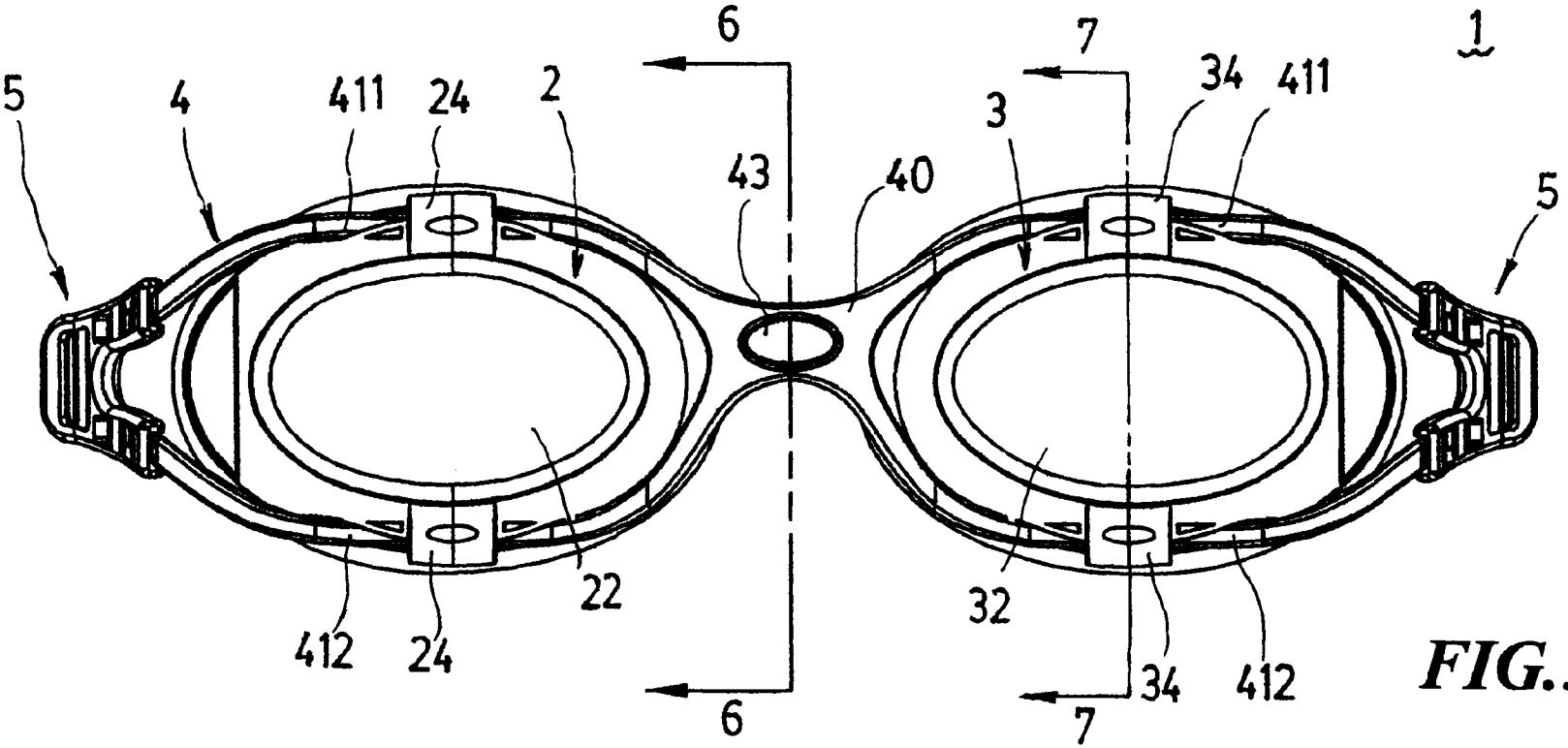
FIG. 5 is a front elevational view of the swimming goggles in FIG. 2.
Figure 7:
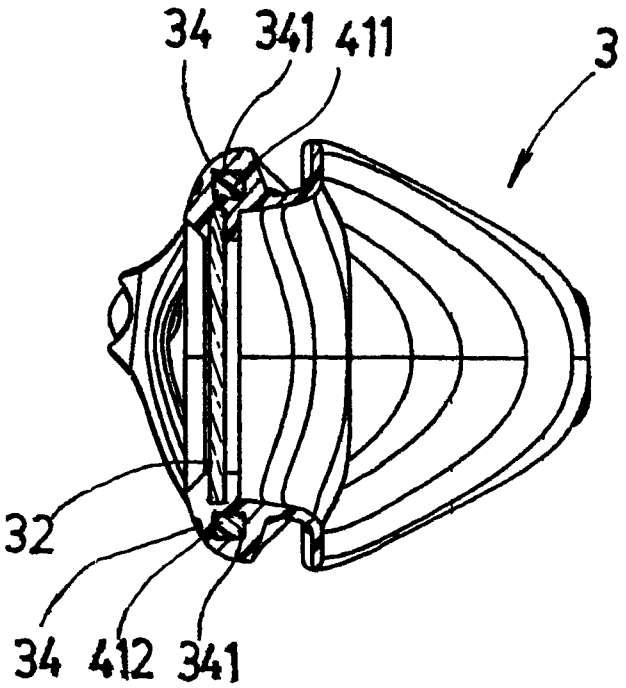
FIG. 7 is a cross-section view of the swimming goggles along line 7—7 of FIG. 5.
Figure 6:
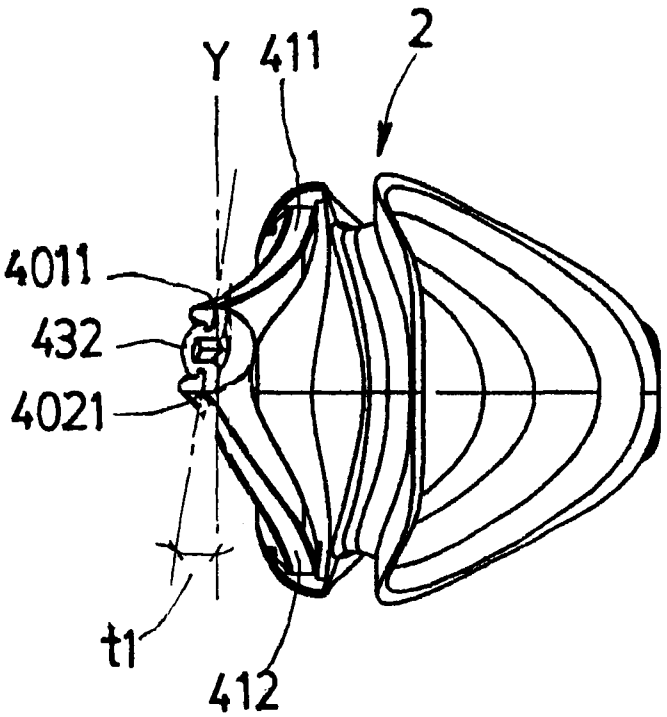
FIG. 6 is a cross-section view of the swimming goggles along line 6—6 of FIG. 5.

Referred to FIGS. 1, 5 and 6, the nose bridge 4 is made of flexible and rigid material, and includes a body portion 40. The body portion 40 has an outer surface and inner surface for touching wearer's nose. The inner surface has an upper edge 401 and a lower edge 402. A line continuing along the highest 4011 of the upper edge 401 and the lowest 4021 of the lower edge 402 forms an angle t1 with the Y axial (as shown in FIG. 6). It should be understood the inner surfaces of the upper edge 401 and the lower edge 402 are located in different orientation, so as to be conformed with the slope of a wearer's nose in use. A hole 403 is defined in the body portion 40 for receiving a nose pad 43. Referring to FIG. 4, the nose pad 43 has a conformable portion 431 for touching a nose and a joining portion 432 integrally formed with the conformable portion 431. The joining portion 432 has a neck 433 which is engaged to the hole 403 of the body portion 40. The conformable portion 431 is generally in an arc shape for matching with the wearer's nose. A guide portion 41 has a first bar 411 and a second bar 412 which respectively extend from the upper edge 401 and the lower edge 402 of the body portion 40. The second bar 412 cooperate with each other to form a fork shape, which will be more conformable with the wearer's nose and more comfortable through the body portion 40, the first bar 411 and the second bar 412 in wear. Moreover, each of said first bar 411 and said second bar 412 has a parallel section 413 for providing each lens frame 2, 3 moving thereon. In FIG.7, the shape and size of the receiving holes 341 is the same as the lateral section of the first bar 411 and the second bar 412 in order to move each of the lens frames 2,3 securely along the first bar 411 and the second bar 412, thereby causing the lens unit 22,23 to be parallel with a wearer's eyeball. A connection portion 42 extends from the end of the parallel section 413 of the first bar 41 land the second bar 412 and is bended near the lens frames 2,3. Several stoppers 421 are located on the connection portion 42.

The fastener mechanism 5 is generally a board and includes an assembled section 50 coupled with said connection portion 42 and a strap linking section 51 connected to said head strap. The assembled section 50 includes two concave housings 501 which are mounted on the board for accommodation the first bar 411 and the second bar 412 respectively, and a several openings 502 which are respectively disposed on the concave housings 501 for engaging with the stoppers 421. The strap linking section 51 includes two assembled holes 510 which are mounted on the board for positioning the head strap.

Figure 2:
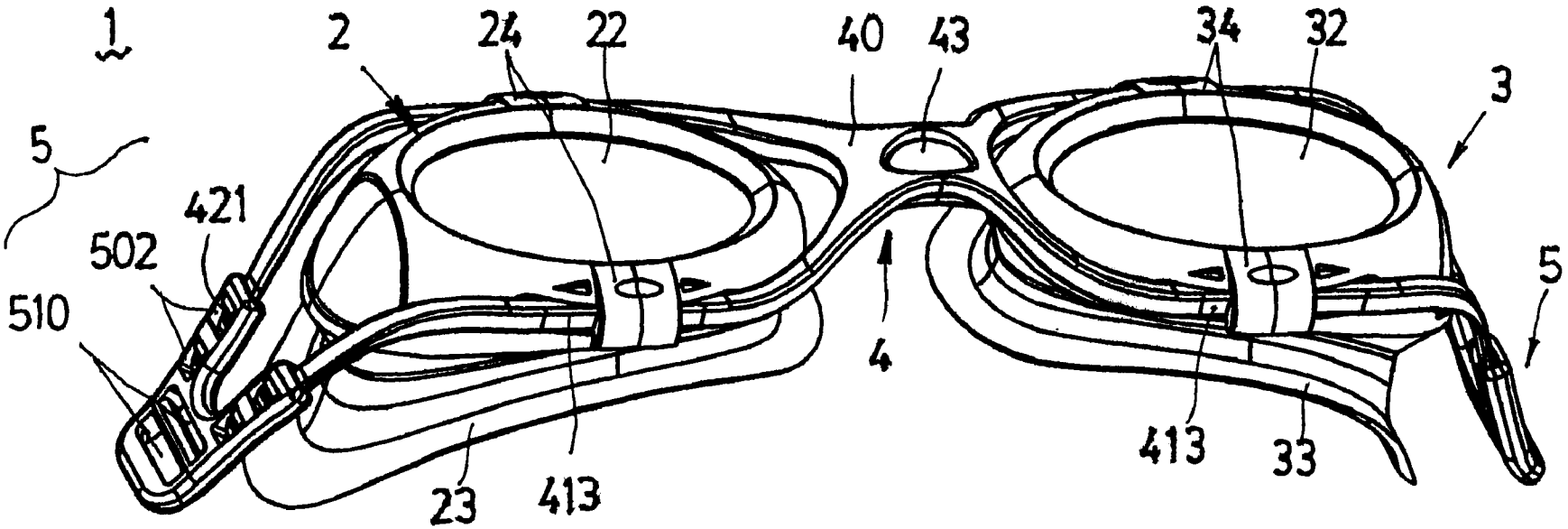
FIG. 2 is a perspective assembled view of FIG. 1.
Figure 3:
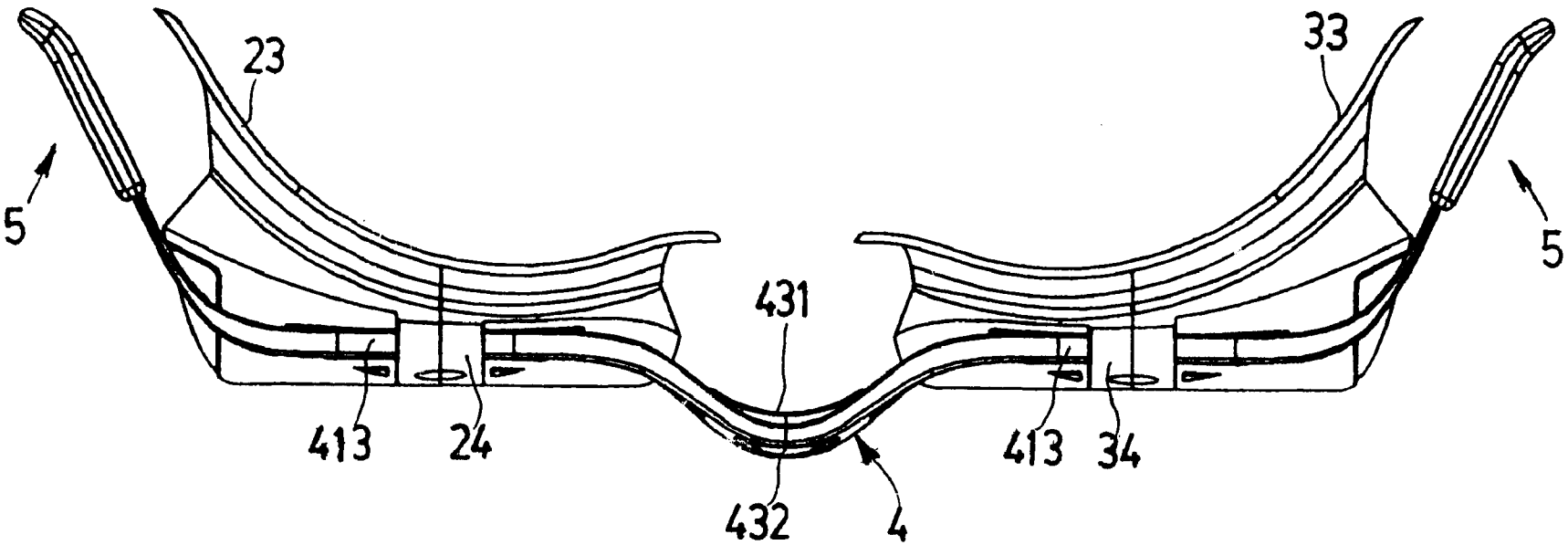
FIG. 3 is a top plan view of the swimming goggles in FIG. 2.

Referring to FIGS. 2 and 3, in assembly, the lens units 22,32 is inserted into the lens retaining space 21,31 of the lens frames 2,3. The lens frames 2,3 are joined together by the first bar 411 and the second bar 412 passing through the receiving holes 241,341. The stoppers 421 of each connection portion 42 of the first bar 411 and the second bar 412 are engaged to the openings 502 of each concave housings 501 of the fastener mechanism 5. Thus, the lens frames 2,3 are securely assembled into one unit. After assembly, the connection bases 24,34 are located on the parallel section 413 of the first bar 411 land the second bar 412. Referring to FIG. 7, it is obvious that the shape and size of the receiving holes 241,341 are the same as the lateral section of the first bar 411 and the second bar 412 in order to move each lens frames 2,3 securely along the first bar 411 and the second bar 412, thereby causing a lens unit 22,23 to be parallel with the wearer's eyeball, and to allow good peripheral vision without distorting the swimmer's view. Furthermore, a wearer does not take off the swimming goggles 1 during adjusting because each lens frame 2,3 can be respectively moved along the parallel section 413 of the first bar 411 and the second bar 412. The lens frames 2, 3 do not adversely affect each other during adjusting, and can be securely matched with the periphery of the wearer's eyeholes respectively for getting more comfortable and preventing effectively the seepage of water when the swimming goggles 1 is in use.

While the present invention has been described in connection with what is considered the most practical and preferred embodiment, it is understood that this invention is not limited to the disclosed embodiments but is intended to cover various arrangements included within the spirit and scope of the broadest interpretation so as to encompass all such modifications and equivalent arrangements, for example the connection bases 24,34 of the lens frames 2,3 comprise accommodating hole with clasp opening for securing the first bar 411 and the second bar 412 instead of the receiving holes 241,341, or deleting the connection portion 42 to connect the head strap on the outer side of each lens frame, or the nose pad is made of foam instead of plastics and be directly fixed on the body portion by agglutinant etc.

What is claimed is:

1. Swimming goggles comprising:

left and right lens frames, each having an inner periphery that defines a lens retaining space for receiving a lens unit, upper and lower portions of the periphery of the left and right lens frames having at least a connection base with a receiving hole therein;

a nose bridge connecting inner sides of the left and right lens frames;

a head strap;

wherein the nose bridge includes:

a body portion for touching a wearer's nose;

a guide portion having a first bar and a second bar respectively extending from opposite sides of the body portion and passing through the receiving hole of each connection base, each of the first bar and the second bar having a parallel section for providing the left and right lens frames to move thereon; and a connection portion extending from an end of the first bar and the second bar respectively;

a fastener mechanism connecting the head strap and having an assembled section coupling with the connection portion, and a strap linking section connecting the head strap.

2. The swimming goggles as claimed in claim 1, wherein two pairs of connection bases are formed at the upper and lower portions of the periphery of the left and right lens frames for holding when each lens frame is adjusted.

3. The swimming goggles as claimed in claim 1, wherein the connection portion extends from the end of the parallel section of the first bar and the second bar and is bended near each lens frame, and several stoppers are located on the connection portion.

4. The swimming goggles as claimed in claim 1, further comprising a nose pad have a conformable portion for touching a nose and a joining portion integrally formed with the conformable portion, and the joining portion has a neck engaged to a hole of the body portion.

5. The swimming goggles as claimed in claim 1, wherein the body portion has an outer surface and an inner surface for touching the wearer's nose, the inner surface has an upper edge and a lower edge which are located in different orientation, so as to conformed with the slope of the wearer's nose in use.

6. The swimming goggles as claimed in claim 5, wherein the first bar and the second bar respectively extend from the upper edge and the lower edge of the body portion and cooperate with each other to form a fork shape.

7. The swimming goggles as claimed in claim 6, wherein the assembled section of the fastener mechanism includes two concave housings accommodating with the first bar and the second bar respectively, and several openings respectively disposed in the concave housings, and the strap linking section includes two assembled holes positioning the head strap.

8. The swimming goggles as claimed in claim 1, wherein the shape and size of the receiving holes is the same as the lateral section of the first bar and the second bar in order to move each lens frame securely along the first bar and the second bar, thereby causing each lens unit to be parallel with a wearer's eyeball.

9. Swimming goggles comprising:

left and right lens frames, each having an inner periphery that defines a lens retaining space for receiving a lens unit, upper and lower portions of the periphery of the left and right lens frames having at least a connection base with a receiving hole therein, and a head strap connecting outer sides of the left and right lens frames; and a nose bridge connecting the left and right lens frames;

wherein the nose bridge includes:

a body portion having an outer surface and an inner surface for touching a wearer's nose; and a guide portion having a first bar and a second bar with a parallel section respectively extending from opposite sides of the body portion and passing through the receiving hole of each the connection base.

10. The swimming goggles as claimed in claim 9, wherein a plurality of connection base is respectively protruded on the upper and lower portions of the periphery of the left and right lens frames for holding when each lens frame is adjusted.

11. The swimming goggles as claimed in claim 10, the shape and size of the receiving holes is the same as the lateral section of the first bar and the second bar in order to move each lens frame securely along the first bar and the second bar, thereby causing a lens unit to be parallel with a wearer's eyeball.

12. Swimming goggles comprising:

left and right lens frames, each having an inner periphery that defines a lens retaining space for receiving a lens unit, upper and lower portions of the periphery of the left and right lens frames having at least a connection base with a receiving hole therein, and a head strap located at outer sides of the left and right lens frames; and a nose bridge connecting the left and right lens frames, wherein the nose bridge includes:

a body portion with a nose pad on an inner side thereof which comprises a conformable portion for touching a wearer's nose and a joining portion engaging with the body portion; and a guide portion with a first bar and a second bar respectively extending from opposite sides of the body portion and passing through the receiving hole of the connection base.

13. The swimming goggles as claimed in claim 12, wherein the joining portion is integrally formed with the conformable portion and has a neck engaging with a hole of the body portion.

14. The swimming goggles as claimed in claim 13, wherein the conformable portion is generally in an arc shape for matching with the wearer's nose.

* * * * *